US011152705B2

(12) United States Patent
Falk et al.

(10) Patent No.: US 11,152,705 B2
(45) Date of Patent: Oct. 19, 2021

(54) RECONFIGURABLE GEOMETRIC METASURFACES WITH OPTICALLY TUNABLE MATERIALS

(71) Applicant: International Business Machines Corporation, Armonk, NY (US)

(72) Inventors: Abram L. Falk, Port Chester, NY (US); Jessie Carrigan Rosenberg, Mount Vernon, NY (US); Kafai Lai, Poughkeepsie, NY (US); Damon Brooks Farmer, White Plains, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/522,297

(22) Filed: Jul. 25, 2019

(65) Prior Publication Data

US 2021/0028547 A1 Jan. 28, 2021

(51) Int. Cl.

| | |
|---|---|
| ***H01Q 3/30*** | (2006.01) |
| ***H01Q 3/44*** | (2006.01) |
| ***H01Q 9/04*** | (2006.01) |

(52) U.S. Cl.

CPC ..... *H01Q 9/0442* (2013.01); *H01Q 3/30* (2013.01); *H01Q 3/44* (2013.01)

(58) Field of Classification Search

CPC ..... H01Q 9/0442; H01Q 3/30; H01Q 3/44

See application file for complete search history.

(56) References Cited

U.S. PATENT DOCUMENTS

| | | | | |
|---|---|---|---|---|
| 9,923,267 | B1 | 3/2018 | Pala et al. | |
| 2013/0093641 | A1* | 4/2013 | Ng | H01Q 1/521 343/841 |
| 2014/0085693 | A1 | 3/2014 | Mosallaei et al. | |
| 2016/0013549 | A1 | 1/2016 | Schaffner et al. | |
| 2016/0025914 | A1 | 1/2016 | Brongersma et al. | |
| 2017/0212285 | A1 | 6/2017 | Arbabi et al. | |
| 2018/0351092 | A1 | 12/2018 | Giessen et al. | |

(Continued)

OTHER PUBLICATIONS

N. Yu et al., "Light Propagation with Phase Discontinuities: Generalized Laws of Reflection and Refraction," Science, Oct. 21, 2011, pp. 333-337, vol. 334, No. 6054.

(Continued)

*Primary Examiner* — Henry Luong

(74) *Attorney, Agent, or Firm* — Anthony Curro; Ryan, Mason & Lewis, LLP

(57) ABSTRACT

An apparatus includes two or more groups of antennas, each including two or more patches of optically tunable material providing two or more antennas. The tunable geometric metasurface also includes a control circuit including a plurality of switches providing current sources and a ground voltage. The plurality of switches are coupled to respective ones of the patches of optically tunable material in each of the groups of antennas via first electrodes. The ground voltage is coupled to respective ones of the patches of optically tunable material in each of the groups of antennas via second electrodes. The control circuit is configured to modify states of the antennas in each of the groups of antennas utilizing the first electrodes and the second electrodes to adjust reflectivity of the patches of optically tunable material to provide a tunable geometric metasurface.

20 Claims, 10 Drawing Sheets

(56) References Cited

U.S. PATENT DOCUMENTS

| | | | | |
|---|---|---|---|---|
| 2019/0018299 | A1* | 1/2019 | Park | G02F 1/0123 |
| 2019/0064551 | A1 | 2/2019 | Gooth et al. | |
| 2019/0285798 | A1* | 9/2019 | Akselrod | H01Q 3/2676 |

OTHER PUBLICATIONS

D.E. Anagnostou et al., "Integration of Resistive Heaters for Phase-Change Reconfigurabie Antennas," 11th European Conference on Antennas and Propagation (EUCAP), 2017, pp. 2349-2350.

G. Kaplan et al., "Dynamically Controlled Plasmonic Nano-antenna Phased Array Utilizing Vanadium Dioxide," Optical Materials Express, Nov. 24, 2015, pp. 2513-2524, vol. 5, No. 11.

C.H. Chu et al., "Active Dielectric Metasurface Based on Phase-change Medium," Laser Photonics Rev., 2016, pp. 986-994, vol. 10, No. 6.

Y.Y. Au et al., "Phase-change Devices for Simultaneous Optical-electrical Applications," Science Reports, Aug. 29, 2017, pp. 1-7, vol. 7.

T. Cao et al., "Ultrafast Beam Steering Using Gradient Au—Ge_2Sb_2Te_5 -Au Plasmonic Resonators," Optics Express, Jul. 13, 2015, p. 18029, vol. 23, No. 14.

S.Y. Lee et al., Holographic Image Generation with a Thin-film Resonance Caused by Chalcogenide Phase-change Material, Scientific Reports, Jan. 24, 2017, pp. 1-8; vol. 7.

A. Karvounis et al., "All-dielectric Phase-change Reconfigurable Metasurface," Applied Physics Letters, 2016, pp. 051103-1-051103-5, vol. 109.

P. Hosseini et al., "An Optoelectronic Framework Enabled by Low-dimensional Phase-change Films," Nature, Jul. 10, 2014, pp. 206-211, vol. 511.

* cited by examiner

150

100

750

700

RECONFIGURABLE GEOMETRIC METASURFACES WITH OPTICALLY TUNABLE MATERIALS

BACKGROUND

The present application relates to optics, and more specifically, to techniques for forming metasurfaces. A metasurface includes a two-dimensional array of optical antennas or elements used to direct light. A geometric metasurface is a type of metasurface in which the elements thereof are copies of a single antenna at various rotation angles. Metasurfaces may be used for three-dimensional imaging, holographic displays and various other use cases.

SUMMARY

Embodiments of the invention provide techniques for forming reconfigurable geometric metasurfaces comprising optically tunable materials.

In one embodiment, an apparatus comprises two or more groups of antennas, each group of antennas comprising two or more patches of optically tunable material providing two or more antennas. The tunable geometric metasurface also comprises a control circuit comprising a plurality of switches providing current sources and a ground voltage. The plurality of switches are coupled to respective ones of the two or more patches of optically tunable material in each of the two or more groups of antennas via first electrodes. The ground voltage is coupled to respective ones of the two or more patches of optically tunable material in each of the two or more groups of antennas via second electrodes. The control circuit is configured to modify states of the two or more antennas in each of the two or more groups of antennas utilizing the first electrodes and the second electrodes to adjust reflectivity of the patches of optically tunable material to provide a tunable geometric metasurface.

In another embodiment, a semiconductor structure comprises a substrate, a patch of optically tunable material disposed over the substrate, a first electrode coupled to the patch of optically tunable material and a switch providing a current source, and a second electrode coupled to the patch of optically tunable material and a ground voltage. The first electrode and the second electrode are configured to modify a state of the patch of optically tunable material to adjust a reflectivity of the patch of optically tunable material.

In another embodiment, a method comprises determining a desired interference effect for a plurality of groups of antennas, each group of antennas comprising two or more patches of optically tunable material providing two or more antennas, the two or more patches of optically tunable material being coupled via first electrodes to switches providing current sources and via a second electrode to a ground voltage. The method also comprises utilizing a control circuit to modify states of the antennas in each of the two or more groups of antennas to provide the desired interference effect. The control circuit comprises a plurality of switches providing current sources and a ground voltage, each of the two or more patches of optically tunable material in each of the plurality of groups of antennas being coupled to the ground voltage via first electrodes and to one of the plurality of switches via second electrodes. The control circuit modifies the states of the antennas in each of the two or more groups of antennas utilizing the first electrodes and the second electrodes to adjust reflectivity of the patches of optically tunable material.

DETAILED DESCRIPTION

Figure 1B:
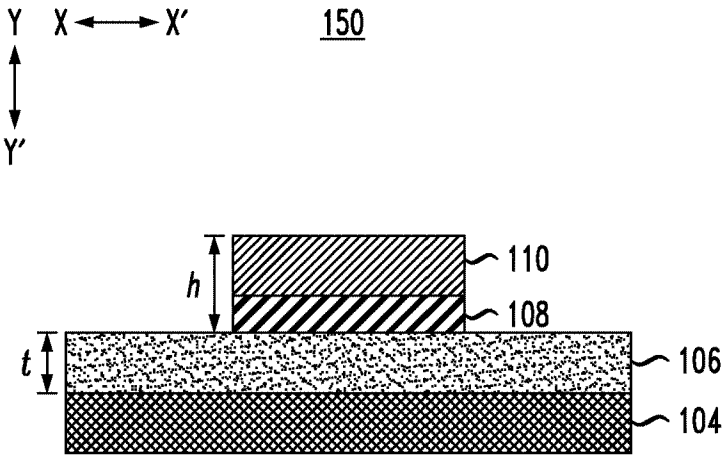
FIG. 1B depicts a side cross-sectional view of the FIG. 1A tunable geometric-phase antenna, according to an embodiment of the invention.

Illustrative embodiments of the invention may be described herein in the context of illustrative methods for forming reconfigurable geometric metasurfaces comprising optically tunable materials. However, it is to be understood that embodiments of the invention are not limited to the illustrative methods, apparatus, systems and devices but instead are more broadly applicable to other suitable methods, apparatus, systems and devices.

Metasurfaces are two-dimensional arrays of microwave, infrared or optical antennas. When light is incident on a metasurface, each antenna provides a unique intentional delay to the light that is incident on it before. Each antenna may also absorb some of the light that is incident on it before radiating it. Thus, when a light beam is reflected or transmitted by a metasurface, it has a two-dimensionally varying phase and/or amplitude imprinted on it by the metasurface. Through optical interference and diffraction, this spatially varying phase and/or amplitude response then allows the metasurface to direct light fields into complex patterns.

Technologically, metasurfaces enable a wide variety of optical elements to be fabricated in a planar, subwavelength-thick chip or circuit. Examples of such optical elements include but are not limited to planar lenses, waveplates, filters, and polarizers. More sophisticated diffractive optical elements and devices, such as computer-generated holograms (CGHs), can also be generated by metasurfaces. For CGHs, a laser or light beam incident on the metasurface can be controllably reflected or transmitted to produce a three-dimensional (3D) image, without the need for specialized 3D glasses. Diffractive optical elements and devices may also be used in 3D imaging applications, solid-state Light Detection and Ranging (LIDAR) applications, etc.

There exists a need for "dynamic" (e.g., tunable or reconfigurable) metasurfaces for these and other applications. In some embodiments, phase-change materials are configured to be electronically switched to change optical properties of antennas in an array of antennas of a metasurface.

Metasurfaces are an evolution of phased arrays of microwave-frequency metal antennas. Increasingly sophisticated micro-fabrication and material technologies enable the miniaturization of these antennas into the infrared and visible domains. Antennas of a metasurface may be metallic or dielectric. Metal antennas can take advantage of plasmonic effects and be especially small (e.g., on the range of 5 to 200 nm), whereas dielectric antennas form photonic cavities that typically have lower loss. One particularly effective technique is to have antennas fabricated on top of a dielectric-mirror stack. An example of an antenna fabricated on top of a dielectric-mirror stack is shown in FIGS. 1A and 1, described in further detail below. In this case, a low quality factor out-of-plane Fabry-Perot resonance across the dielectric is set up, which can enhance the effect of the antennas.

In a geometric metasurface, circularly polarized light is incident on the metasurface and the antennas radiate light whose circular polarization is reversed from that of a flat surface. Geometric metasurfaces can be transmissive metasurfaces or reflective metasurfaces. If right-handed circularly polarized (RCP) light is incident on the geometric metasurface, the reflect light from a reflective metasurface would also be RCP, and the transmitted light from a transmissive metasurface would be left-handed circularly polarized (LCP).

Although each antenna in a geometric metasurface reverses the circular polarization of light, if the antennas are fabricated such that the shape of each antenna is identical but the in-plane rotation angle (denoted $\phi$) of each antenna is different, then the transmitted or reflected light from neighboring antennas will display an interference effect that causes the light to diffract non-orthogonally to the plane of the metasurface.

This interference effect is based on the geometric phase, otherwise known as the Pancharatnam-Berry phase, of the light radiated by the antennas. The geometric phase of light may be visualized on a Poincaré sphere 175 shown in FIG. 1C. In the Poincaré sphere 175, RCP light is at the north pole, LCP light is at the south pole, and linearly polarized light is at the equator. The geometric phase (denoted $\phi_{geom}$) of light radiating from each antenna has a direct relationship to the in-plane antenna rotation angle ($\phi_{geom}=2\phi$). Thus, $\phi_{geom}$ can be readily spatially controlled across the metasurface.

Compared to conventional phase metasurfaces, which comprise a 2D array of antennas whose shape is spatially varied across the array, geometric phase metasurfaces in which the shape is held constant while the orientation is varied have several advantages. For example, geometric phase metasurfaces typically have higher diffraction efficiencies (e.g., the fraction of incident light that is diffracted into the desired optical mode) than ordinary metasurfaces. Geometric phase metasurfaces are also immune to design and fabrication errors. The geometric phase, which is set by the geometric rotation angle of the antenna, can be designed with greater precision than conventional phase metasurfaces. Geometric phase metasurfaces can also be readily designed to be broadband (e.g., to work at a broad span of optical wavelengths).

A need exists, however, for a design of dynamically tunable geometric metasurfaces. One of the key challenges facing the production of tunable geometric metasurfaces is that it is typically difficult to change an antenna's orientation. Illustrative embodiments provide dynamically tunable geometric metasurfaces enabling change in the orientation of antennas.

In some embodiments, a structure is provided that functions as a tunable geometric metasurface. The structure is based on a super-array of antennas that comprises several (e.g., two to six) interpenetrating sub-arrays of antennas. Each sub-array is itself an array of antennas with a fixed orientation. Each antenna in the sub-array incorporates a tunable optical material that allows its resonant frequency to be shifted. This tuning can thus allow each antenna to interact more or less strongly with an incident light beam.

A group or sub-array of several antennas of different orientations form what is referred to herein as a "pixel." If one of the antennas in the pixel is tuned to interact strongly with the incoming light and the other antennas in the pixel are tuned to interact weakly with the incident light, then the strongly interacting antenna will dominate. Thus, by changing which antenna in the pixel strongly interacts with the incoming light, it is possible to effectively "rotate" the dominant antenna. In turn, by rotating the dominant antenna, the geometric phase that the pixel induces on the incident light beam can be varied.

FIGS. 1A and 1, as noted above, illustrate a perspective view 100 and a side cross-sectional view 150 of a tunable geometric-phase antenna. The antenna more particularly includes an etched rectangle of layers 108 and 110 formed over a stack comprising a mirror 104 and a dielectric layer 106.

The mirror 104 may be a metal mirror formed of aluminum (Al), silver (Ag), gold (Au), platinum (Pt), titanium nitride (TiN) or another suitable material. The mirror 104 may have a vertical thickness or height (in direction Y-Y') in the range of 50 nm to 500 nm.

The dielectric layer 106 may be formed of magnesium fluoride ($MgF_2$), silicon dioxide ($SiO_2$), silicon nitride (SiN), titanium oxide (TiO) or another suitable material. The dielectric layer 106 may have a vertical thickness or height (in direction Y-Y'), denoted t in FIG. 1B, in the range of 30 nm to 500 nm.

The antenna includes, in this embodiment, a thin film of phase-change material (PCM) 108 and a dielectric layer 110. The PCM 108 may be formed of a chalcogenide PCM such as germanium antimony telluride ($Ge_xSb_yTe_z$), germanium telluride ($Ge_xTe_y$), antimony telluride ($Sb_xTe_y$), silver antimony telluride ($Ag_xSb_yTe_z$), silver indium antimony telluride ($Ag_wIn_xSb_yTe_z$), etc. In some embodiments, $Ge_2Sb_2Te_5$ is used for the PCM 108. In other embodiments, $Ge_3Sb_2Te_2$, GeTe, SbTe, or AgInSbTe may be used.

In these chalcogenide PCMs, the chalcogenide can be thermally switched between a crystalline phase and an amorphous phase. For example, a current pulse may be used to Joule-heat an amorphous phase chalcogenide PCM (e.g., $Ge_xSb_yTe_z$) to a temperature of about 300 degrees Celsius (° C.), which causes the amorphous phase chalcogenide PCM to crystallize. A higher power but slower current pulse may be used to Joule-heat the crystalline phase chalcogenide PCM to a temperature of about 600° C. which causes the crystalline phase chalcogenide PCM to melt-quench into the amorphous phase. In these two different phases, the chalcogenide has different optical properties. Thus, the resonant frequency of the antennas can be switched.

In other embodiments, however, the PCM 108 may be replaced with a different tunable optical material, such as an electrically tunable plasmonic material (e.g., graphene, carbon nanotubes, a metal oxide, a metal nitride such as titanium nitride (TiN), etc.), a metal-insulator transition material (e.g., vanadium dioxide ($VO_2$), etc.), an ion-drive electrochromic material such as tungsten oxide ($WO_3$), etc. While various embodiments are described below in the context of using a PCM as the tunable optical material, it should be appreciated that the PCM may be replaced with these alternatives as desired for a particular implementation. The PCM 108 may have a vertical thickness or height (in direction Y-Y') in the range of 3 nm to 300 nm.

The dielectric layer 110 may be formed of $MgF_2$, $SiO_2$, SiN, TiO or another suitable material. The dielectric layer 110 may have a vertical thickness or height (in direction Y-Y') in the range of 3 nm to 300 nm.

The antenna formed from the stack of layers 108 and 110 may have a length (denoted L in FIG. 1A) in the range of 30 nm to 500 nm, a width (denoted w in FIG. 1A) in the range of 30 nm to 500 nm, and a total height (denoted h in FIG. 1B) in the range of 10 nm to 100 nm. The antenna formed from the stack of layers 108 and 110 has a rotation angle (denoted f in FIG. 1A) in the range of 0 to 180 degrees. The stack of layers 108 and 110 may be referred to as a "patch" of optically tunable material. In FIG. 1A and other figures described below, the patches of optically tunable material are rectangular for providing patch antennas, though it should be appreciated that other shapes of patches of optically tunable material may be used as desired.

Figure 1A:
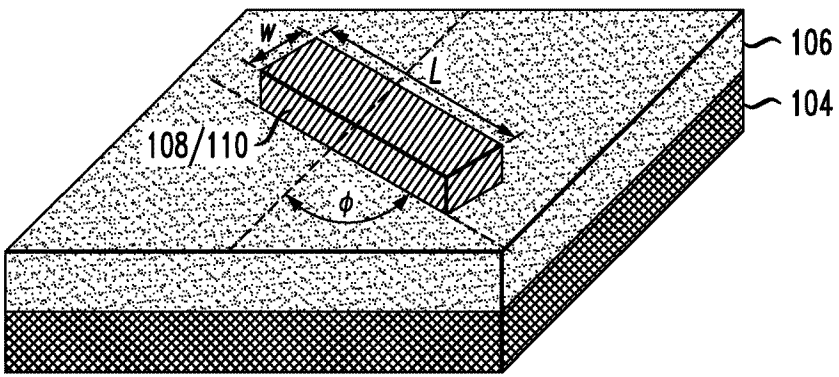
FIG. 1A depicts a perspective view of a tunable geometric-phase antenna, according to an embodiment of the invention.
Figure 1C:
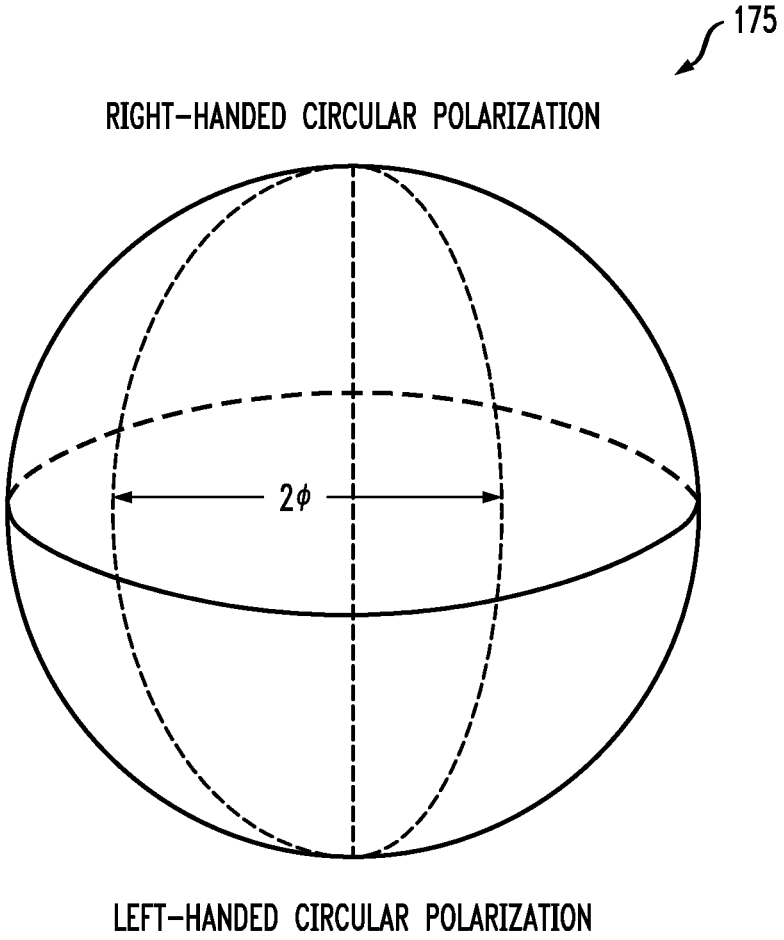
FIG. 1C depicts a Poincaré sphere representing the polarization of light, according to an embodiment of the invention.

FIGS. 1A and 1B show an exemplary implementation of a single tunable geometric-phase antenna, where the antenna includes an etched rectangle of a the PCM 108 and dielectric layer 110 on top of a stack of mirror 104 and dielectric layer 106. The length L, width wand height h of the etched antenna, along with the thickness t are co-optimized to reverse the circular polarization of light when it is reflected. FIG. 1C, as noted above, illustrates the Poincaré sphere 175 representing the polarization of light. The north pole of the Poincaré sphere 175 represents RCP and the south pole of the Poincaré sphere 175 represents LCP. When light reflects off of an ordinary mirror its circular polarization reverses. The geometric-phase antenna of FIGS. 1A and 1B is designed so that the RCP light reflects as right-handed and the left-handed incident light reflects to have LCP (e.g., its phase is reversed from that of light reflecting off of an ordinary mirror).

Figure 2:
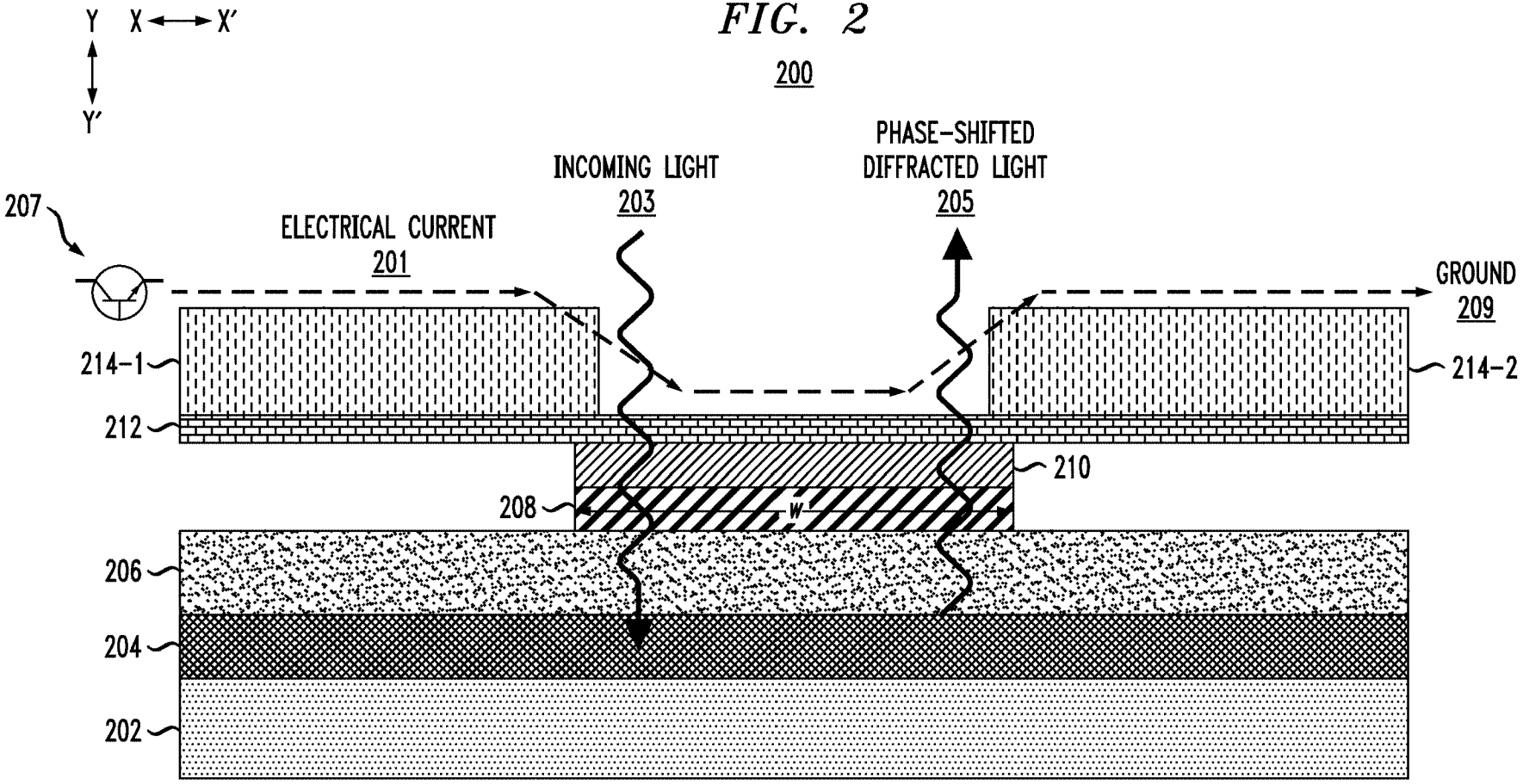
FIG. 2 depicts a side cross-sectional view of a pixel of a reconfigurable geometric metasurface, according to an embodiment of the invention.
Figure 3:
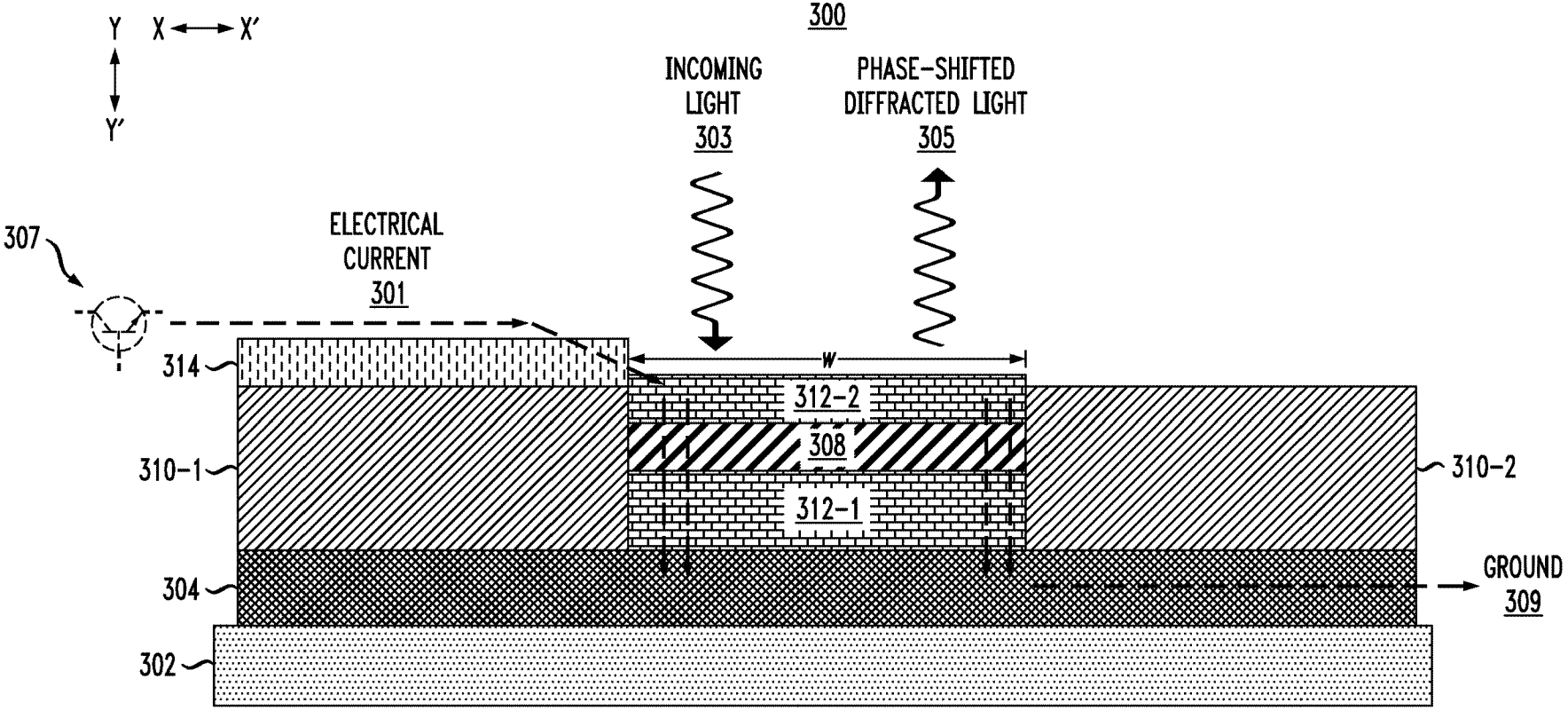
FIG. 3 depicts another side cross-sectional view of a pixel of a reconfigurable geometric metasurface, according to an embodiment of the invention.
Figure 4:
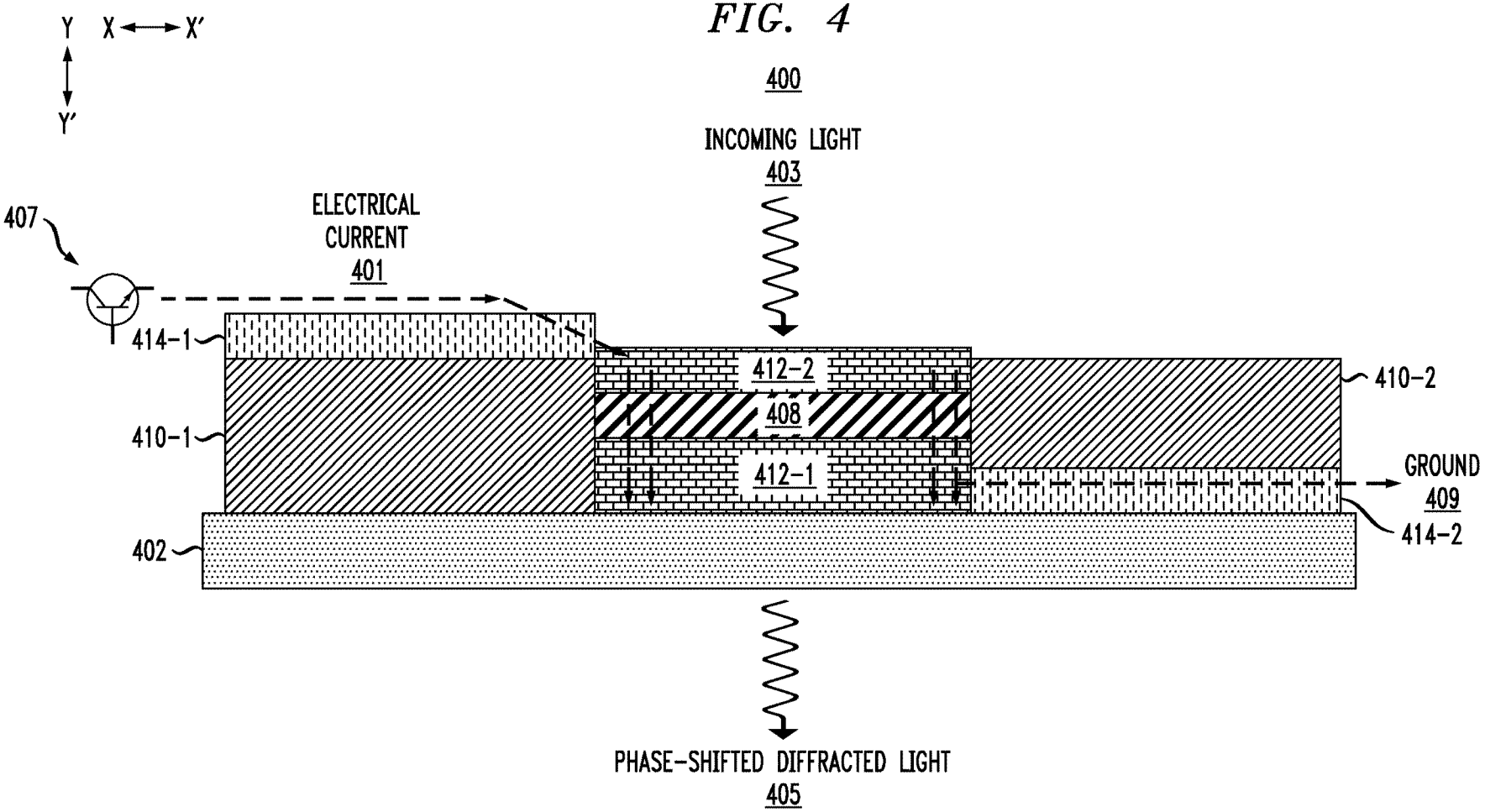
FIG. 4 depicts another side cross-sectional view of a pixel of a reconfigurable geometric metasurface, according to an embodiment of the invention.

FIGS. 2-4 show side cross-sectional view 200, 300 and 400, respectively, of different implementations for a pixel of a reconfigurable geometric metasurface. FIG. 2 shows an example of a pixel, including a substrate 202, mirror 204, dielectric layer 206, PCM 208, dielectric layer 210, transparent conductor layer 212, and electrodes 214-1 and 214-2.

The substrate 202 may be formed of silicon (Si) or another suitable material such as glass, calcium fluoride ($CaF_2$), zinc selenide (ZnSe) or another suitable material. The substrate 202 may have a vertical thickness or height (in direction Y-Y') in the range of 50 micrometers (m) to 1000 m.

The mirror 204, dielectric layer 206, PCM 208 and dielectric layer 210 may be formed of similar materials and with similar sizing as that described above with respect to mirror 104, dielectric layer 106, PCM 108 and dielectric layer 110, respectively.

The transparent conductor 212 may be formed of indium tin oxide (ITO) or another suitable material such as TiN, an AZO compound, etc. The transparent conductor 212 may have a vertical thickness or height (in direction Y-Y') in the range of 5 nm to 200 nm.

The electrodes 214-1 and 214-2 (collectively, electrodes 214) may be formed of platinum (Pt) or another suitable refractory material such as TiN, tantalum nitride (TaN), tungsten (W), etc. The electrodes 214 may have a vertical thickness or height (in direction Y-Y') in the range of 50 nm to 500 nm. Each of the electrodes 214 may have a horizontal thickness or width (in direction X-X') in the range of 100 nm to 500 nm.

In the pixel shown in FIG. 2, the substrate 202 and electrodes 214 are used for Joule heating the PCM 208 to switch its phase (e.g., from crystalline to amorphous and vice-versa). Electrical current 201 flows from a switch 207 through the electrode 214-1 to electrode 214-2 connected to ground 209. The electrical current 201 passes through the transparent conductor 212 and dielectric layer 210, heating the PCM 208 to change its phase. Incoming light 203 that is incident on the antenna of FIG. 2 is then reflected as phase-shifted diffracted light 205. The phase-shifted diffracted light 205 has a geometric phase that varies based on the state of the pixel.

FIG. 3 shows another example of a pixel, including a substrate 302, mirror 304, PCM 308 disposed between two transparent conductors 312-1 and 312-2, insulator layers 310-1 and 310-2, and electrode 314. The mirror 304 in the FIG. 3 embodiment functions as an electrode that contacts the bottom transparent conductor 312-1. The top transparent conductor 312-2 contacts the electrode 314 that runs current 301 from switch 307 to ground 309 through the transparent conductors 312-1 and 312-2 and the PCM 308 between. The electrode 314 is electrically protected from the mirror 304 by the insulator layers 310-1 an 310-2. Similar to the pixel of FIG. 2, incoming light 303 that is incident on the pixel of FIG. 3 is reflected as phase-shifted diffracted light 305, controllably based on the phase of the PCM 308.

The substrate 302, mirror 304, PCM 308 and electrode 314 may be formed of similar materials and with similar sizing as that described above with respect to the substrate 202, mirror 104, PCM 108 and electrode 214, respectively. The transparent conductors 312-1 and 312-2 (collectively, transparent conductors 312) may be formed of similar materials as that described above with respect to the transparent conductor 212. Each of the transparent conductors 312 may have a vertical thickness or height (in direction Y-Y') in the range of 5 nm to 200 nm. The insulator layers 310-1 and 310-2 (collectively, insulator layers 310) may be formed of $MgF_2$, $SiO_2$, SiN, TiO or another suitable material.

FIG. 4 shows another example of a pixel, including a substrate 402, PCM 408 disposed between transparent conductors 412-1 and 412-2 (collectively, transparent conductors 412), electrodes 414-1 and 414-2 (collectively, electrodes 414), and insulator layers 410-1 and 410-2 (collectively, insulator layers 410). The FIG. 4 pixel is similar to that of the FIG. 3 pixel, although the FIG. 4 pixel does not include a bottom mirror and thus incoming light 403 incident on the antenna is transmitted (rather than reflected as in FIG. 3) as phase-shifted diffracted light 405. Electrical current 401 from switch 407 flows through electrode 414-1, the transparent conductors 412 and PCM 408, and to electrode 414-2 to ground 409.

The substrate 402, PCM 408, insulator layers 410 and transparent conductors 412 may be formed of similar materials and with similar sizing as that described above with respect to substrate 202, PCM 108, insulator layers 310 and transparent conductors 312. The electrodes 414 may be formed of similar materials as those described above with respect to the electrodes 212. Each of the electrodes 414 may have a vertical thickness or height (in direction Y-Y') in the range of 50 nm to 500 nm.

In the pixel structures shown in FIGS. 2-4, the PCM is enclosed in a low quality-factor resonator. In the cases of FIGS. 2 and 3, the low quality-factor resonator comprises a back-plane mirror along with dielectric materials on both the top and bottom of the PCM 208/308. In the case of FIG. 4, the back-plane mirror is omitted. These resonator arrangements may be used to enhance the diffraction efficiency of the patterned antenna formed from the patch of optically tunable material (e.g., PCM 208, 308, 408). The diffraction efficiency of a metasurface is defined as the fraction of light whose circular polarization is reversed by the antennas. This is also the fraction of light that can participate in the geometrical phase interference, and thus contribute to a desired image.

It should be appreciated that the pixels of FIGS. 2-4 are presented by way of example only, and that embodiments are not limited to these specific configurations of pixels. Various other arrangements may be used, including variations for transmission versus reflection of incident light, different arrangements of electrodes, insulator layers, transparent conductors, etc. Further, as noted above, while the pixels of FIGS. 2-4 are described with respect to using a PCM as the optically tunable material, in other embodiments various other optically tunable materials may be used in place of or in addition to a PCM.

Figure 5:
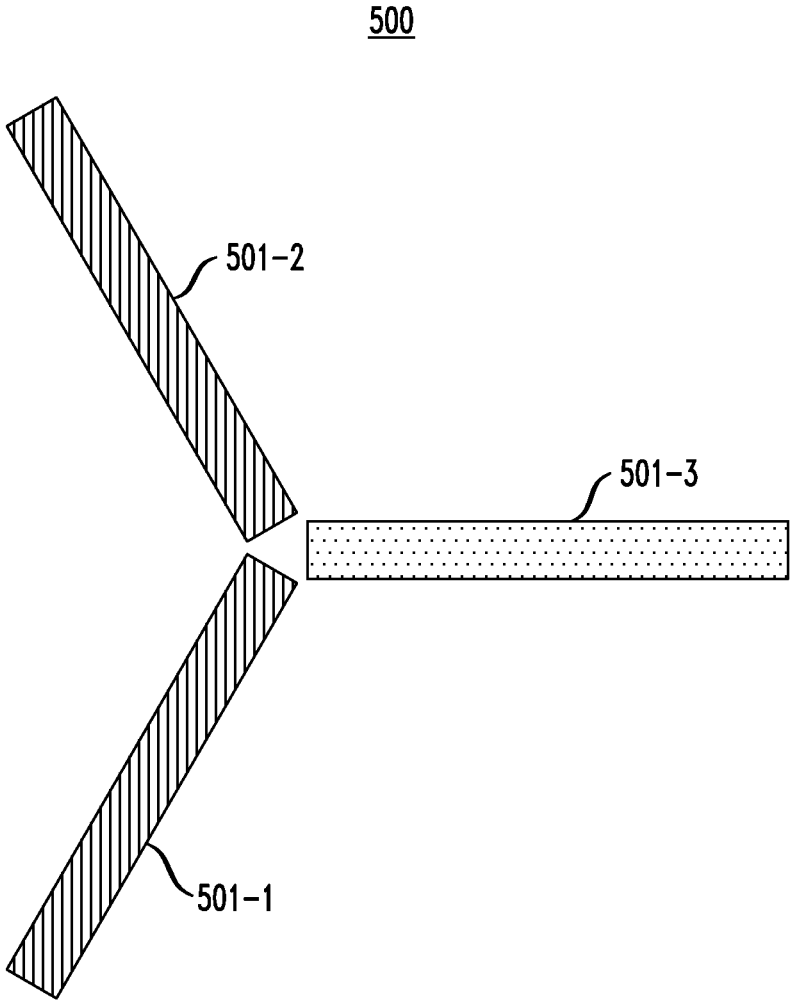
FIG. 5 depicts a top-down view of a pixel of a reconfigurable geometric metasurface comprising three antennas, according to an embodiment of the invention.

FIG. 5 shows a top-down view 500 of a single pixel of a tunable geometric metasurface which includes three antennas denoted 501-1, 501-2 and 501-3 (collectively, antennas 501). Each of the antennas 501 is assumed to incorporate a PCM as described above. One of the antennas 501, antenna 501-3, is tuned to have a different state than the antennas 501-1 and 501-2. For example the antennas 501-1 and 501-2 may comprise amorphous $Ge_2Sb_2Te_5$, while the antenna 501-3 may comprise crystalline $Ge_2Sb_2Te_5$. The crystalline $Ge_2Sb_2Te_5$ antenna 501-3 has a significantly higher reflectivity than the amorphous $Ge_2Sb_2Te_5$ antennas 501-1 and 501-2. The antenna 501-3 is thus the dominant antenna of the FIG. 5 pixel and determines the $\phi$ of light that is reflected (or transmitted) from the FIG. 5 pixel.

Figure 6:
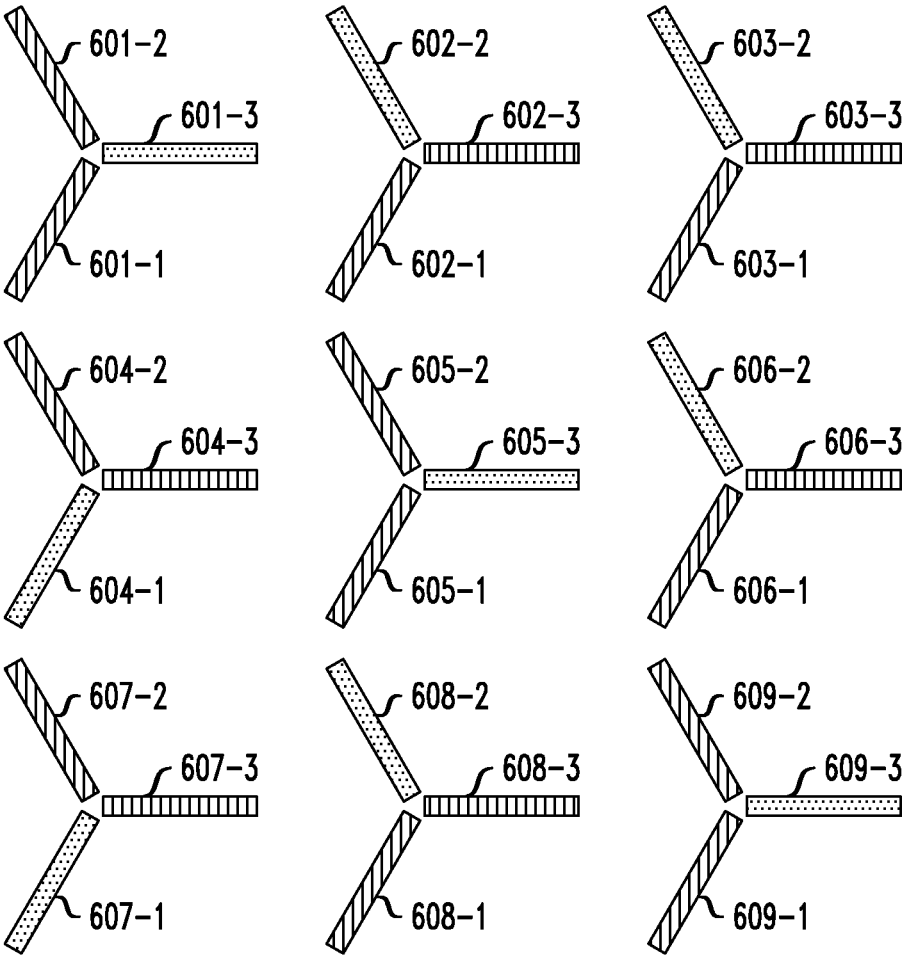
FIG. 6 depicts a top-down view of an array of pixels of a reconfigurable geometric metasurface, according to an embodiment of the invention.

FIG. 6 shows a top-down view 600 of a square array of pixels of the type shown in FIG. 5. More particularly, FIG. 6 shows a 3×3 square array, including a first pixel with antennas 601-1, 601-2 and 601-3 (collectively, antennas 601), a second pixel with antennas 602-1, 602-2 and 602-3 (collectively, antennas 602), a third pixel with antennas 603-1, 603-2 and 603-3 (collectively, antennas 603), a fourth pixel with antennas 604-1, 604-2 and 604-3 (collectively, antennas 604), a fifth pixel with antennas 605-1, 605-2 and 605-3 (collectively, antennas 605), a sixth pixel with antennas 606-1, 606-2 and 606-3 (collectively, antennas 606), a seventh pixel with antennas 607-1, 607-2 and 607-3 (collectively, antennas 607), an eighth pixel with antennas 608-1, 608-2 and 608-3 (collectively, antennas 608), and a ninth pixel with antennas 609-1, 609-2 and 609-3 (collectively, antennas 609). In each pixel in the 3×3 square array shown in FIG. 6, the particular antenna that is crystalline varies (the dominant antennas include antenna 601-3, 602-2, 603-2, 604-1, 605-3, 606-2, 607-1, 608-2 and 609-3). The dominant antenna of each pixel in the FIG. 6 array has a varying orientation, and the $\phi$ induced varies from pixel to pixel. The transmitted or reflected light from neighboring antennas can thus diffract non-orthogonally to the plane of the metasurface due to optical interference.

It should be appreciated that although FIG. 6 shows a square array of nine pixels (e.g., 3×3), in other embodiments a square array of pixels may have more or fewer than nine pixels (e.g., a 2×2 array of four pixels, a 4×4 array of sixteen pixels, a 5×5 array of twenty-five pixels, etc.). As will be described in further detail below with respect to FIG. 8, embodiments are not limited solely to square arrays of pixels. Various other arrangements may be used, including a hexagonal lattice or array such as that shown in FIG. 8 described below.

Figure 7B:
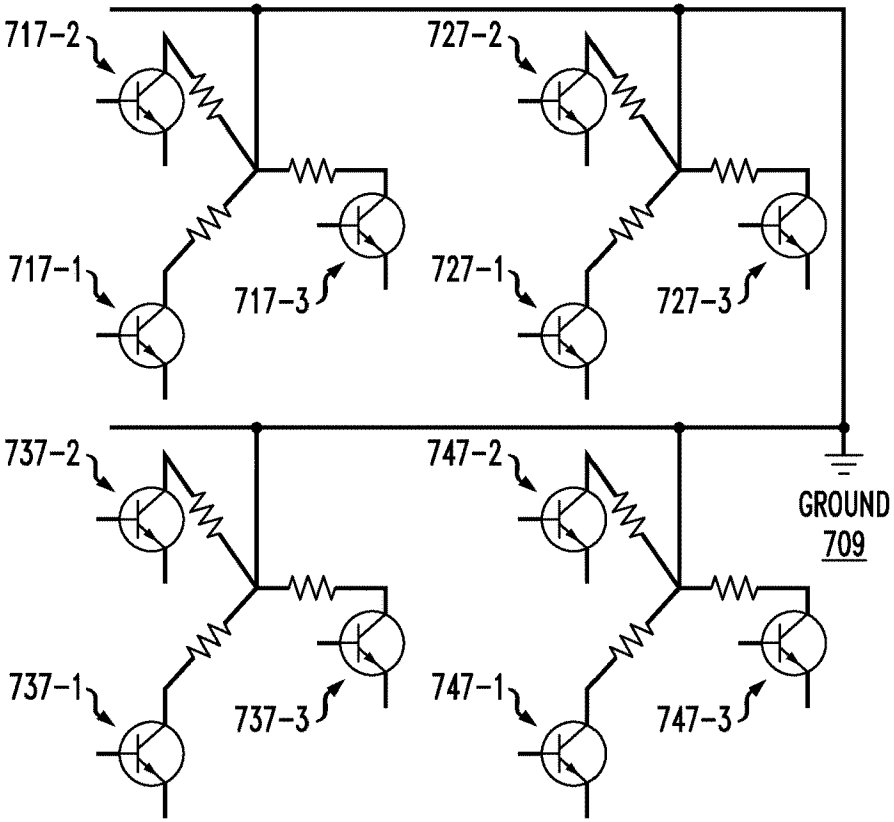
FIG. 7B depicts a schematic view of electrical connections between the pixels of the FIG. 7A reconfigurable geometric metasurface, according to an embodiment of the invention.
Figure 7A:
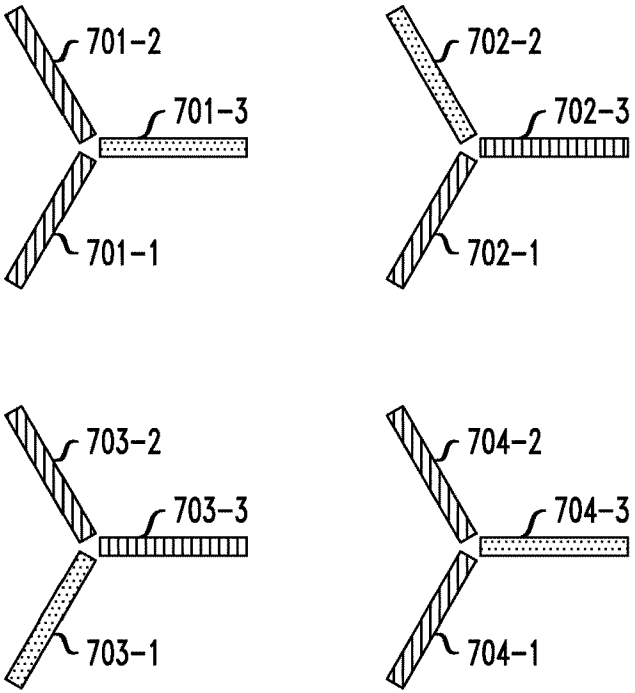
FIG. 7A depicts a top-down view of an array of pixels of a reconfigurable geometric metasurface, according to an embodiment of the invention.

FIG. 7A shows a top-down view 700 of an array of four pixels in a 2×2 square array. The first pixel includes antennas 701-1, 701-2 and 701-3 (collectively, antennas 701), the second pixel includes antennas 702-1, 702-2 and 702-3 (collectively, antennas 702), the third pixel includes antennas 703-1, 703-2 and 703-3 (collectively, antennas 703), and the fourth pixel includes antennas 704-1, 704-2 and 704-3 (collectively, antennas 704). As with the 3×3 square array shown in FIG. 6, in each pixel of the 2×2 square array of FIG. 7A the particular antenna that is dominant (e.g., crystalline) varies. For example, the dominant antennas include antenna 701-3, 702-2, 703-1 and 704-3. FIG. 7B shows a schematic 750 of electrical connection of the antennas in the four pixels shown in FIG. 7A. The outside point of a transparent conductor on top of each of the antennas is attached to a transistor (e.g., antennas 701-1, 701-2, 701-3, 702,-1, 702-2, 702-3, 703-1, 703-2, 703-3, 704-1, 704-2 and 704-3 are attached to transistors 717-1, 717-2, 717-3, 727-1, 727-2, 727-3, 737-1, 737-2, 737-3, 747-1, 747-2 and 747-3, respectively). The transistors 717-1, 717-2, 717-3, 727-1, 727-2, 727-3, 737-1, 737-2, 737-3, 747-1, 747-2 and 747-3 source current to the different antennas to switch the antennas as desired (e.g., from crystalline to amorphous and vice-versa), and cut off current to the antennas otherwise. At the center point of the antennas of each pixel is a common electrical ground point 709 as shown.

Figure 8:
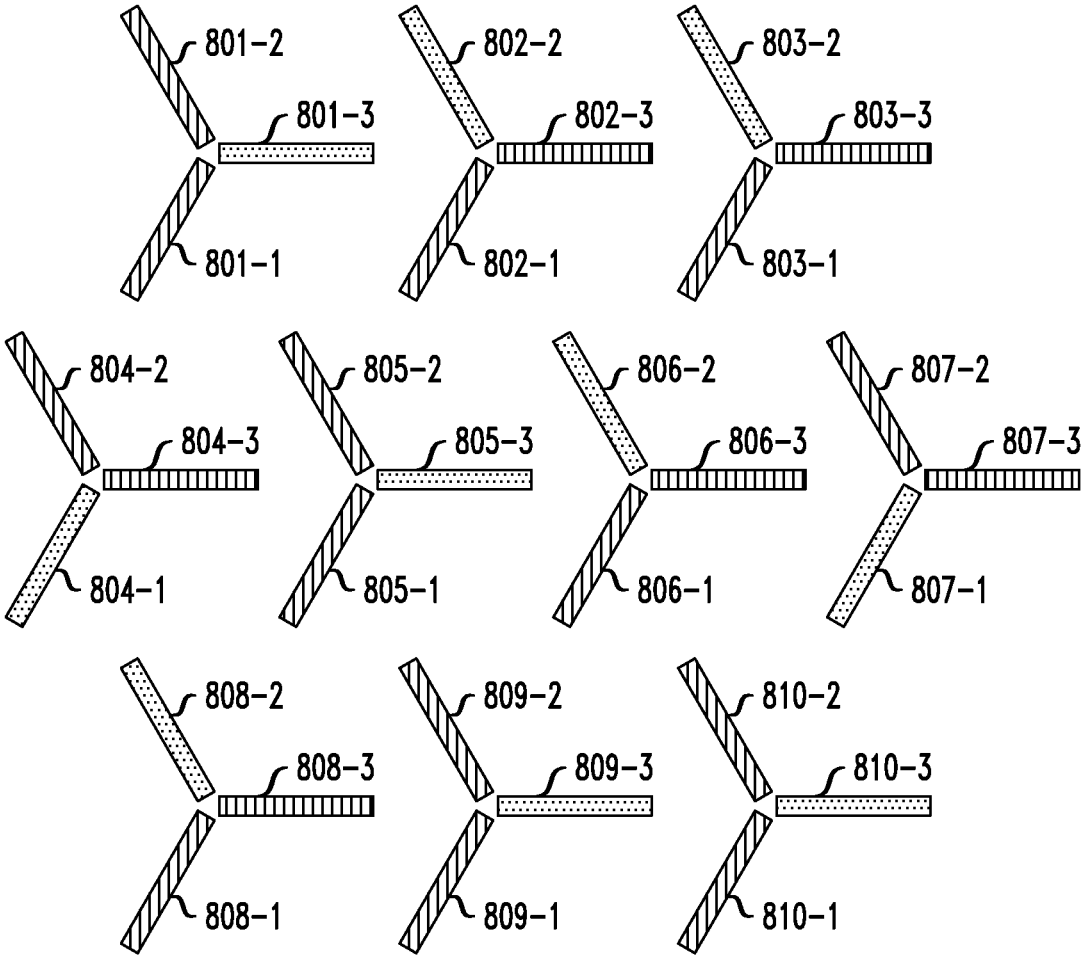
FIG. 8 depicts a top-down view of another array of pixels of a reconfigurable geometric metasurface, according to an embodiment of the invention.

FIG. 8 shows a top-down view 800 of a hexagonal lattice of pixels. More particular, FIG. 8 shows a hexagonal lattice of ten pixels. Each pixel includes three antennas as shown, with the first pixel including antennas 801-1, 801-2 and 801-3 (collectively, antennas 801), the second pixel including antennas 802-1, 802-2 and 802-3 (collectively, antennas 802), the third pixel including antennas 803-1, 803-2 and 803-3 (collectively, antennas 803), the fourth pixel including antennas 804-1, 804-2 and 804-3 (collectively, antennas 804), the fifth pixel including antennas 805-1, 805-2 and 805-3 (collectively, antennas 805), the sixth pixel including antennas 806-1, 806-2 and 806-3 (collectively, antennas 806), the seventh pixel including antennas 807-1, 807-2 and 807-3 (collectively, antennas 807), the eighth pixel including antennas 808-1, 808-2 and 808-3 (collectively, antennas 808), the ninth pixel including antennas 809-1, 809-2 and 809-3 (collectively, antennas 809), and the tenth pixel including antennas 810-1, 810-2 and 810-3 (collectively, antennas 810). As with the arrays shown in FIGS. 6 and 7A, the dominant (e.g., crystalline) antenna in each pixel of the FIG. 8 array varies (antennas 801-3, 802-2, 803-2, 804-1, 805-3, 806-2, 807-1, 808-2, 809-3 and 810-3 are dominant in each pixel).

The hexagonal lattice of pixels shown in FIG. 8 allows for the pixels to be more closely spaced to one another, as compared to the square lattices shown in FIGS. 6 and 7A. Thus, the diffraction angle of the reflected light in the hexagonal lattice of FIG. 8 can be greater.

Figure 9:
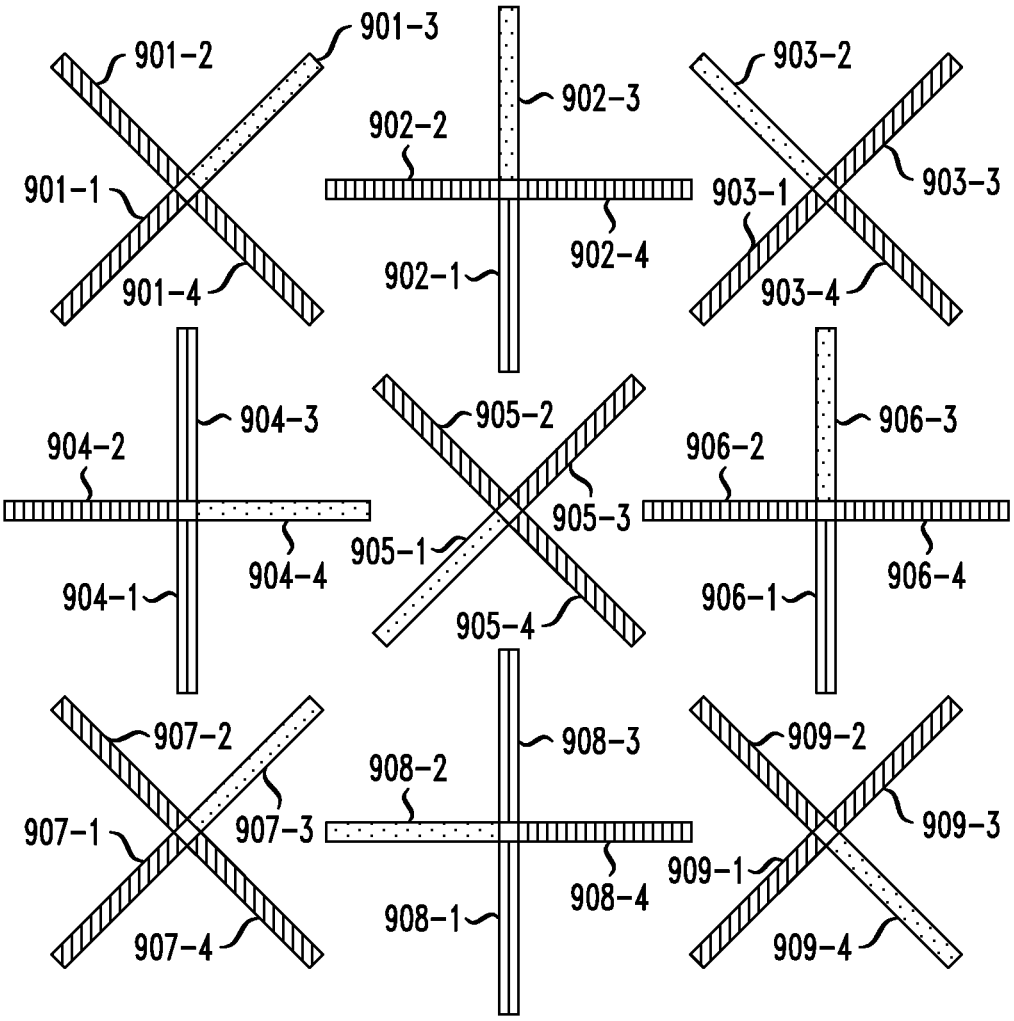
FIG. 9 depicts a top-down view of another array of pixels of a reconfigurable geometric metasurface, according to an embodiment of the invention.

FIG. 9 shows a top-down view of another array of pixels, where each pixel in the array includes four antennas (rather than three antennas as in the arrays of FIGS. 6, 7A and 8). The FIG. 9 array includes nine pixels, each having four antennas. The first pixel includes antennas 901-1, 901-2, 901-3 and 901-4 (collectively, antennas 901), the second pixel includes antennas 902-1, 902-2, 902-3 and 902-4 (collectively, antennas 902), the third pixel includes antennas 903-1, 903-2, 903-3 and 903-4 (collectively, antennas 903), the fourth pixel includes antennas 904-1, 904-2, 904-3 and 904-4 (collectively, antennas 904), the fifth pixel includes antennas 905-1, 905-2, 905-3 and 905-4 (collectively, antennas 905), the sixth pixel includes antennas 906-1, 906-2, 906-3 and 906-4 (collectively, antennas 906), the seventh pixel includes antennas 907-1, 907-2, 907-3 and 907-4 (collectively, antennas 907), the eighth pixel includes antennas 908-1, 908-2, 908-3 and 908-4 (collectively, antennas 908), and the ninth pixel includes antennas 909-1, 909-2, 909-3 and 909-4 (collectively, antennas 909). Again, each of the pixels includes a dominant (e.g., crystalline) antenna, including antennas 901-3, 902-3, 903-2, 904-4, 905-1, 906-3, 907-3, 908-2 and 909-4.

The advantage of the FIG. 9 array is that the greater number of antennas per pixel allows the geometric phase of the reflected light to be more accurately controlled leading to a higher fidelity routing of the diffracted light. The disadvantage of the FIG. 9 array is that it is more complex to fabricate (e.g., it requires more transistors and wiring). In the FIG. 9 array, it is seen that the orientation of the antennas varies from pixel to pixel, but in each pixel the four antennas are at 45 degrees relative to its nearest neighbors. This advantageously allows the pixels of the FIG. 9 array to be more closely spaced to one another. It should be noted that, as a practical matter, there is a limit beyond which reduced spacing between pixels provides no advantage or diminishing returns. For example, as the packing of pixels approaches one-half the wavelength of the light being transmitted or reflected, reduced spacing may not provide any advantage.

While FIGS. 5-8 illustrate examples where each pixel includes three antennas and FIG. 9 illustrates an example where each pixel includes four antennas, it should be appreciated that in other embodiments each pixel may include five or more antennas. Further, it should be appreciated that in a given array of pixels, each pixel need not include the same number of antennas. For example, in some arrays there may be combinations where some pixels have three antennas and other pixels have four antennas (or five antennas, six antennas, etc.). This allows for different packing of pixels as desired for particular implementations. Further, it should be appreciated that in some embodiments two or more antennas of a given pixel may be made "dominant" to produce a desired reflection or transmission of the incident light. Also, different pixels or different antennas within a pixel may utilize different types of tunable optical materials (e.g., some pixels and/or antennas may use PCM, while other pixels and/or antennas may use an electrically tunable plasmonic material, etc.)

In some embodiments, an apparatus comprises two or more groups of antennas, each group of antennas comprising two or more patches of optically tunable material providing two or more antennas. The tunable geometric metasurface also comprises a control circuit comprising a plurality of switches providing current sources and a ground voltage. The plurality of switches are coupled to respective ones of the two or more patches of optically tunable material in each of the two or more groups of antennas via first electrodes. The ground voltage is coupled to respective ones of the two or more patches of optically tunable material in each of the two or more groups of antennas via second electrodes. The control circuit is configured to modify states of the two or more antennas in each of the two or more groups of antennas utilizing the first electrodes and the second electrodes to adjust reflectivity of the patches of optically tunable material to provide a tunable geometric metasurface.

Each of the two or more groups of antennas may comprise three or more patches of optically tunable material providing three or more antennas.

The control circuit may be configured to modify the states of the two or more patches of optically tunable material in each of the two or more groups of antennas such that a single one of the antennas in each of the two or more groups of antennas has higher reflectively than other ones of the antennas in that group of antennas.

The two or more patches of optically tunable material of each of the two or more groups of antennas may have a same orientation over a top surface of a substrate.

The two or more patches of optically tunable material of a first one of the two or more groups of antennas may have a first orientation over a top surface of a substrate and the two or more patches of the optically tunable material of a second one of the two or more groups of antennas may have a second orientation over the top surface of the substrate different than the first orientation.

A given one of the two or more patches of optically tunable material in a given one of the plurality of groups of antennas may comprise chalcogenide phase change material. The control circuit may be configured to modify the state of the given antenna provided by the given patch of optically tunable material by providing a current from the first electrode coupled to the given patch of optically tunable material to the second electrode coupled to the given patch of optically tunable material to heat the chalcogenide phase change material to change a phase of the chalcogenide phase change material from one of crystalline and amorphous to the other one of crystalline and amorphous.

In some embodiments, a semiconductor structure comprises a substrate, a patch of optically tunable material disposed over the substrate, a first electrode coupled to the patch of optically tunable material and a switch providing a current source, and a second electrode coupled to the patch of optically tunable material and a ground voltage. The first electrode and the second electrode are configured to modify a state of the patch of optically tunable material to adjust a reflectivity of the patch of optically tunable material.

The patch of optically tunable material may comprise a chalcogenide phase-change material, and the first electrode and the second electrode may be configured to modify the state of the chalcogenide phase-change material via heating to change the chalcogenide phase-change material between an amorphous and a crystalline phase. The chalcogenide phase-change material may comprise at least one of $Ge_xSb_yTe_z$, $Ge_xTe_y$, $Sb_xTe_y$ and $Ag_xSb_yTe_z$.

The optically tunable material may comprise an electrically tunable plasmonic material. The electrically tunable plasmonic material may comprise at least one of graphene, carbon nanotubes, a metal oxide and a metal nitride.

The optically tunable material may comprise a metal-insulator transition material. The metal-insulator transition material may comprise $VO_2$.

The semiconductor structure may further comprise a first dielectric layer disposed between the substrate and the patch of optically tunable material, a second dielectric layer disposed over the patch of optically tunable material, and a transparent conductor disposed over the second dielectric layer. The first electrode and the second electrode are disposed over the transparent conductor at opposite ends of the patch of optically tunable material. The semiconductor structure may further comprise a metal mirror disposed between the substrate and the first dielectric layer.

The semiconductor structure may further comprise a first transparent conductor disposed between the substrate and the patch of optically tunable material, a second transparent conductor disposed over the patch of optically tunable material, a first insulator layer disposed over the substrate adjacent a first end of the patch of optically tunable material, and a second insulator layer disposed over the substrate adjacent a second end of the patch of optically tunable material. The first electrode is disposed over the first insulator layer and the second electrode is disposed between the substrate and the second insulator layer. The semiconductor structure may further comprise a metal mirror disposed between the substrate and the first insulator layer, the first transparent conductor and the second insulator layer, the metal mirror providing the second electrode.

The semiconductor structure may further comprise one or more additional patches of optically tunable material and one or more additional electrodes coupled to respective ones of the one or more additional patches of optically tunable material and one or more additional switches providing one or more additional current sources. Each of the one or more additional patches of optically tunable material is coupled to the second electrode providing the ground voltage. The second electrode and the one or more additional electrodes are configured to modify states of the one or more additional patches of optically tunable material to adjust reflectivity of the one or more additional patches of optically tunable material.

In some embodiments, a method comprises determining a desired interference effect for a plurality of groups of antennas, each group of antennas comprising two or more patches of optically tunable material providing two or more antennas, the two or more patches of optically tunable material being coupled via first electrodes to switches providing current sources and via a second electrode to a ground voltage. The method also comprises utilizing a control circuit to modify states of the antennas in each of the two or more groups of antennas to provide the desired interference effect. The control circuit comprises a plurality of switches providing current sources and a ground voltage, each of the two or more patches of optically tunable material in each of the plurality of groups of antennas being coupled to the ground voltage via first electrodes and to one of the plurality of switches via second electrodes. The control circuit modifies the states of the antennas in each of the two or more groups of antennas utilizing the first electrodes and the second electrodes to adjust reflectivity of the patches of optically tunable material.

A given one of the two or more patches of optically tunable material in a given one of the plurality of groups of antennas may comprise chalcogenide phase change material. Utilizing the control circuit to modify the state of the given antenna provided by the given patch of optically tunable material may comprise providing a current from the first electrode coupled to the given patch of optically tunable material to the second electrode coupled to the given patch of optically tunable material to heat the chalcogenide phase change material to change a phase of the chalcogenide phase change material from one of crystalline and amorphous to the other one of crystalline and amorphous.

It should be understood that the various layers, structures, and regions shown in the figures are schematic illustrations that are not drawn to scale. In addition, for ease of explanation, one or more layers, structures, and regions of a type commonly used to form semiconductor devices or structures may not be explicitly shown in a given figure. This does not imply that any layers, structures, and regions not explicitly shown are omitted from the actual semiconductor structures. Furthermore, it is to be understood that the embodiments discussed herein are not limited to the particular materials, features, and processing steps shown and described herein. In particular, with respect to semiconductor processing steps, it is to be emphasized that the descriptions provided herein are not intended to encompass all of the processing steps that may be required to form a functional semiconductor integrated circuit device. Rather, certain processing steps that are commonly used in forming semiconductor devices, such as, for example, wet cleaning and annealing steps, are purposefully not described herein for economy of description.

Moreover, the same or similar reference numbers are used throughout the figures to denote the same or similar features, elements, or structures, and thus, a detailed explanation of the same or similar features, elements, or structures are not repeated for each of the figures. It is to be understood that the terms "about" or "substantially" as used herein with regard to thicknesses, widths, percentages, ranges, etc., are meant to denote being close or approximate to, but not exactly. For example, the term "about" or "substantially" as used herein implies that a small margin of error is present, such as ±5%, preferably less than 2% or 1% or less than the stated amount.

In the description above, various materials and dimensions for different elements are provided. Unless otherwise noted, such materials are given by way of example only and embodiments are not limited solely to the specific examples given. Similarly, unless otherwise noted, all dimensions are given by way of example and embodiments are not limited solely to the specific dimensions or ranges given.

Semiconductor devices and methods for forming the same in accordance with the above-described techniques can be employed in various applications, hardware, and/or electronic systems. Suitable hardware and systems for implementing embodiments of the invention may include, but are not limited to, personal computers, communication networks, electronic commerce systems, portable communications devices (e.g., cell and smart phones), solid-state media storage devices, functional circuitry, etc. Systems and hardware incorporating the semiconductor devices are contemplated embodiments of the invention. Given the teachings provided herein, one of ordinary skill in the art will be able to contemplate other implementations and applications of embodiments of the invention.

In some embodiments, the above-described techniques are used in connection with semiconductor devices that may require or otherwise utilize, for example, complementary metal-oxide-semiconductors (CMOSs), metal-oxide-semiconductor field-effect transistors (MOSFETs), and/or fin field-effect transistors (FinFETs). By way of non-limiting example, the semiconductor devices can include, but are not limited to CMOS, MOSFET, and FinFET devices, and/or semiconductor devices that use CMOS, MOSFET, and/or FinFET technology.

Various structures described above may be implemented in integrated circuits. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either: (a) an intermediate product, such as a motherboard, or (b) an end product. The end product can be any product that includes integrated circuit chips, ranging from toys and other low-end applications to advanced computer products having a display, a keyboard or other input device, and a central processor.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An apparatus comprising:

two or more groups of antennas, each of the two or more groups of antennas comprising two or more patches of optically tunable material providing two or more antennas; and a control circuit comprising a plurality of switches providing current sources and a ground voltage, the plurality of switches being coupled to respective ones of the two or more patches of optically tunable material in said each of the two or more groups of antennas via first electrodes, the ground voltage being coupled to respective ones of the two or more patches of optically tunable material in each of the two or more groups of antennas via second electrodes;

wherein the control circuit is configured to modify states of the two or more antennas in said each of the two or more groups of antennas utilizing the first electrodes and the second electrodes to adjust reflectivity of the two or more patches of optically tunable material to provide a tunable geometric metasurface;

wherein at least one of the two or more groups of antennas comprises a center point at which first ends of three or more patches of optically tunable material are coupled to a common electrical ground point coupled to the ground voltage; and wherein second ends of the three or more patches of optically tunable material in said at least one of the two or more groups of antennas are spaced apart from one another and coupled to respective transistors providing ones of the plurality of switches that couple the three or more patches of optically tunable material in said at least one of the two or more groups of antennas to the current sources.

2. The apparatus of claim 1, wherein said each of the two or more groups of antennas comprises three or more patches of optically tunable material providing three or more antennas.

3. The apparatus of claim 1, wherein the control circuit is configured to modify the states of the two or more patches of optically tunable material in said each of the two or more groups of antennas such that a single one of the antennas in said each of the two or more groups of antennas has higher reflectively than other ones of the antennas in that group of antennas.

4. The apparatus of claim 1, wherein the two or more patches of optically tunable material of said each of the two or more groups of antennas have a same orientation over a top surface of a substrate.

5. The apparatus of claim 1, wherein the two or more patches of optically tunable material of a first one of the two or more groups of antennas has a first orientation over a top surface of a substrate and wherein the two or more patches of the optically tunable material of a second one of the two or more groups of antennas has a second orientation over the top surface of the substrate different than the first orientation.

6. The apparatus of claim 1, wherein at least a given one of the two or more patches of optically tunable material in at least a given one of the twoor more groups of antennas comprises chalcogenide phase change material, and wherein the control circuit is configured to modify the state of a given antenna provided by the given one of the two or more patches of optically tunable material in the given one of the two or more groups of antennas by providing a current from the first electrode coupled to the given one of the two or more patches of optically tunable material in the given one of the two or more groups of antennas to the second electrode coupled to the given one of the two or more patches of optically tunable material in the given one of the two or more groups of antennas to heat the chalcogenide phase change material to change a phase of the chalcogenide phase change material from a crystalline phase to an amorphous phase or from the amorphous phase to the crystalline phase.

7. The apparatus of claim 1, wherein the second ends of the three or more patches of optically tunable material in said at least one of the two or more groups of antennas are substantially equally spaced apart from one another.

8. The apparatus of claim 1, wherein said at least one of the two or more groups of antennas comprises four or more patches of optically tunable material having first ends that are coupled to the common electrical ground point.

9. The apparatus of claim 1, wherein the two or more groups of antennas are arranged in a square array.

10. The apparatus of claim 1, wherein the two or more groups of antennas are arranged in a hexagonal array.

11. A method comprising:

determining a desired interference effect for a plurality of groups of antennas, each group of antennas comprising two or more patches of optically tunable material providing two or more antennas, the two or more patches of optically tunable material being coupled via first electrodes to switches providing current sources and via a second electrode to a ground voltage; and utilizing a control circuit to modify states of the antennas in each of the two or more groups of antennas to provide the desired interference effect, the control circuit comprising a plurality of switches providing current sources and a ground voltage, each of the two or more patches of optically tunable material in each of the plurality of groups of antennas being coupled to the ground voltage via first electrodes and to one of the plurality of switches via second electrodes, the control circuit modifying the states of the antennas in each of the two or more groups of antennas utilizing the first electrodes and the second electrodes to adjust reflectivity of the patches of optically tunable material;

wherein at least one of the plurality of groups of antennas comprises a center point at which first ends of three or more patches of optically tunable material are coupled to a common electrical ground point coupled to the ground voltage; and wherein second ends of the three or more patches of optically tunable material in said at least one of the plurality of groups of antennas are spaced apart from one another and coupled to respective transistors providing ones of the plurality of switches that couple the three or more patches of optically tunable material in said at least one of the plurality of groups of antennas to the current sources.

12. The method of claim 11, wherein at least a given one of the two or more patches of optically tunable material in at least a given one of the plurality of groups of antennas comprises chalcogenide phase change material, and wherein utilizing the control circuit to modify the state of a given antenna provided by the given one of the two or more patches of optically tunable material in the given one of the plurality of groups of antennas comprises providing a current from the first electrode coupled to the given one of the two or more patches of optically tunable material in the given one of the plurality of groups of antennas to the second electrode coupled to the given one of the two or more patches of optically tunable material in the given one of the plurality of groups of antennas to heat the chalcogenide phase change material to change a phase of the chalcogenide phase change material from a crystalline phase to an amorphous phase or from the amorphous phase to the crystalline phase.

13. The method of claim 11, wherein said each of the plurality of groups of antennas comprises three or more patches of optically tunable material providing three or more antennas.

14. The method of claim 11, further comprising utilizing the control circuit to modify the states of the two or more patches of optically tunable material in said each of the plurality of groups of antennas such that a single one of the antennas in said each of the two or more groups of antennas has higher reflectively than other ones of the antennas in that group of antennas.

15. The method of claim 11, wherein the two or more patches of optically tunable material of said each of the plurality of groups of antennas have a same orientation over a top surface of a substrate.

16. The method of claim 11, wherein the two or more patches of optically tunable material of a first one of the plurality of groups of antennas has a first orientation over a top surface of a substrate and wherein the two or more patches of the optically tunable material of a second one of the plurality of groups of antennas has a second orientation over the top surface of the substrate different than the first orientation.

17. The method of claim 11, wherein the second ends of the three or more patches of optically tunable material in said at least one of the plurality of groups of antennas are substantially equally spaced apart from one another.

18. The method of claim 11, wherein said at least one of the plurality of groups of antennas comprises four or more patches of optically tunable material having first ends that are coupled to the common electrical ground point.

19. The method of claim 11, wherein the plurality of groups of antennas are arranged in a square array.

20. The method of claim 11, wherein the plurality of groups of antennas are arranged in a hexagonal array.

* * * * *